US008137135B2

(12) United States Patent
Lee et al.

(10) Patent No.: US 8,137,135 B2
(45) Date of Patent: Mar. 20, 2012

(54) COAXIAL CABLE CONNECTOR FOR SECURE CONNECTION WITH A TERMINAL ASSEMBLY

(75) Inventors: Chul-Sub Lee, Daegu (KR); Gi-Chan Kwon, Kyungsangbuk-Do (KR)

(73) Assignee: Tyco Electronics AMP Korea Ltd., Kyungsangbuk-Do (KR)

( * ) Notice: Subject to any disclaimer, the term of this patent is extended or adjusted under 35 U.S.C. 154(b) by 0 days.

(21) Appl. No.: 13/082,891

(22) Filed: Apr. 8, 2011

(65) Prior Publication Data

US 2011/0189890 A1 Aug. 4, 2011

Related U.S. Application Data

(63) Continuation of application No. PCT/KR2009/005152, filed on Sep. 10, 2009.

(30) Foreign Application Priority Data

Oct. 9, 2008 (KR) ..... 10-2008-0099149

(51) Int. Cl.
*H01R 13/40* (2006.01)

(52) U.S. Cl. ..... 439/595

(58) Field of Classification Search ..... 439/595, 439/871, 752

See application file for complete search history.

(56) References Cited

U.S. PATENT DOCUMENTS 4,753,612 A * 6/1988 Betsui ..... 439/596
6,736,653 B2 5/2004 Hall et al.
6,840,822 B1 1/2005 Hall et al.

OTHER PUBLICATIONS

International Search Report, application No. PCT/KR2009/005152, dated Sep. 10, 2009, 3 pages.

* cited by examiner

*Primary Examiner* — Tho D Ta
(74) *Attorney, Agent, or Firm* — Barley Snyder

(57) ABSTRACT

The coaxial cable connector according to the invention includes a male connector having a male terminal assembly that connects to a female connector having a female terminal assembly during coupling between the male connector and the female connector. Each of the male and female terminal assemblies includes a catching protrusion, while each connector includes an elastic plate formed at a top of an receiving passageway. The elastic plate includes a catching hole in which the corresponding catching protrusion is caught. Each male and female terminal assemblies includes a groove formed at a side thereof, while the male and female connectors include a fixing piece formed at a side of the receiving passageway thereof. The fixing piece fits in the corresponding groove through a side of a corresponding one of the male and female connectors, whereby the male and female terminal assemblies are dually fixed to the male and female connectors.

21 Claims, 10 Drawing Sheets

(Fig.1)
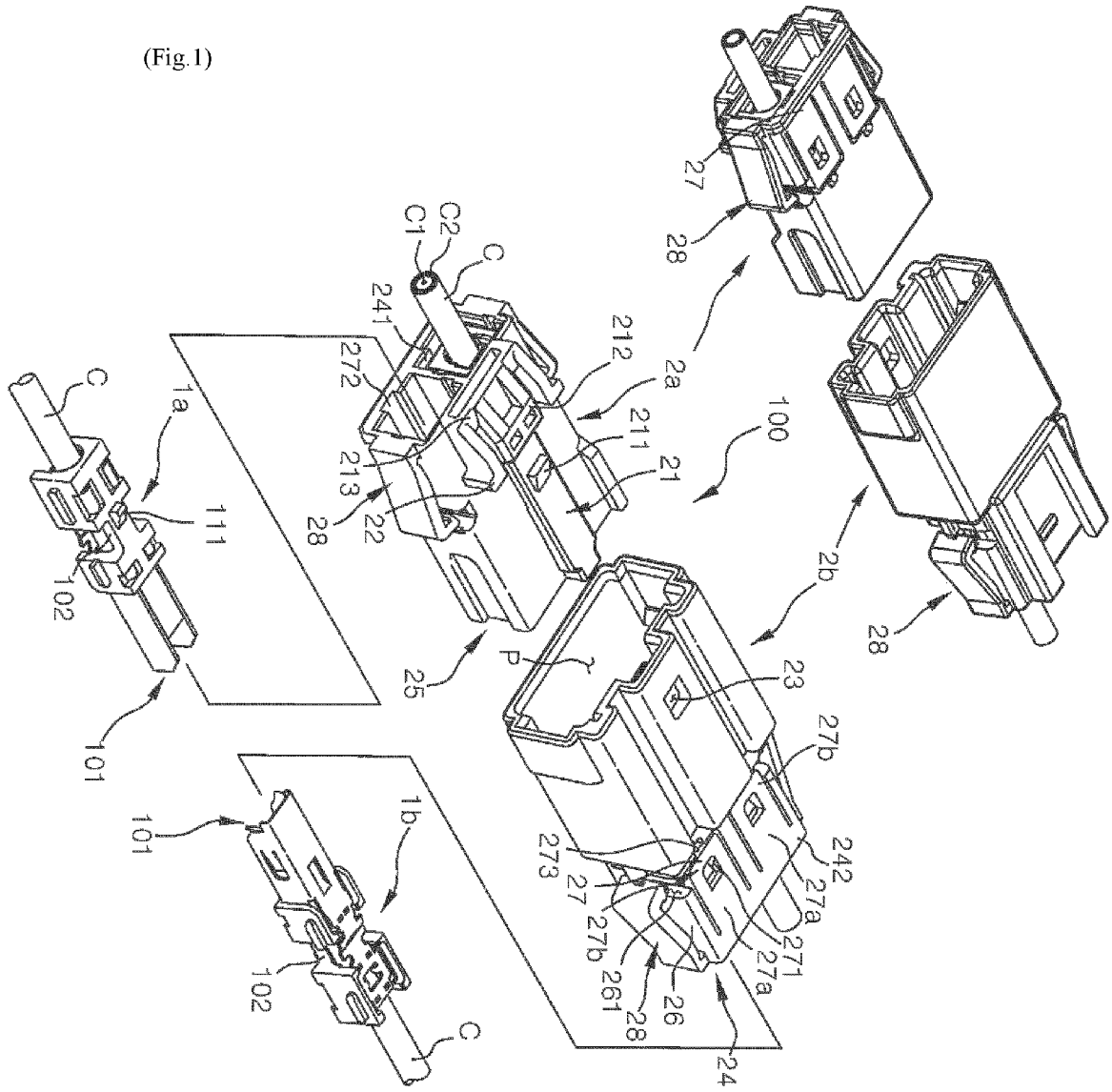

(Fig.2)
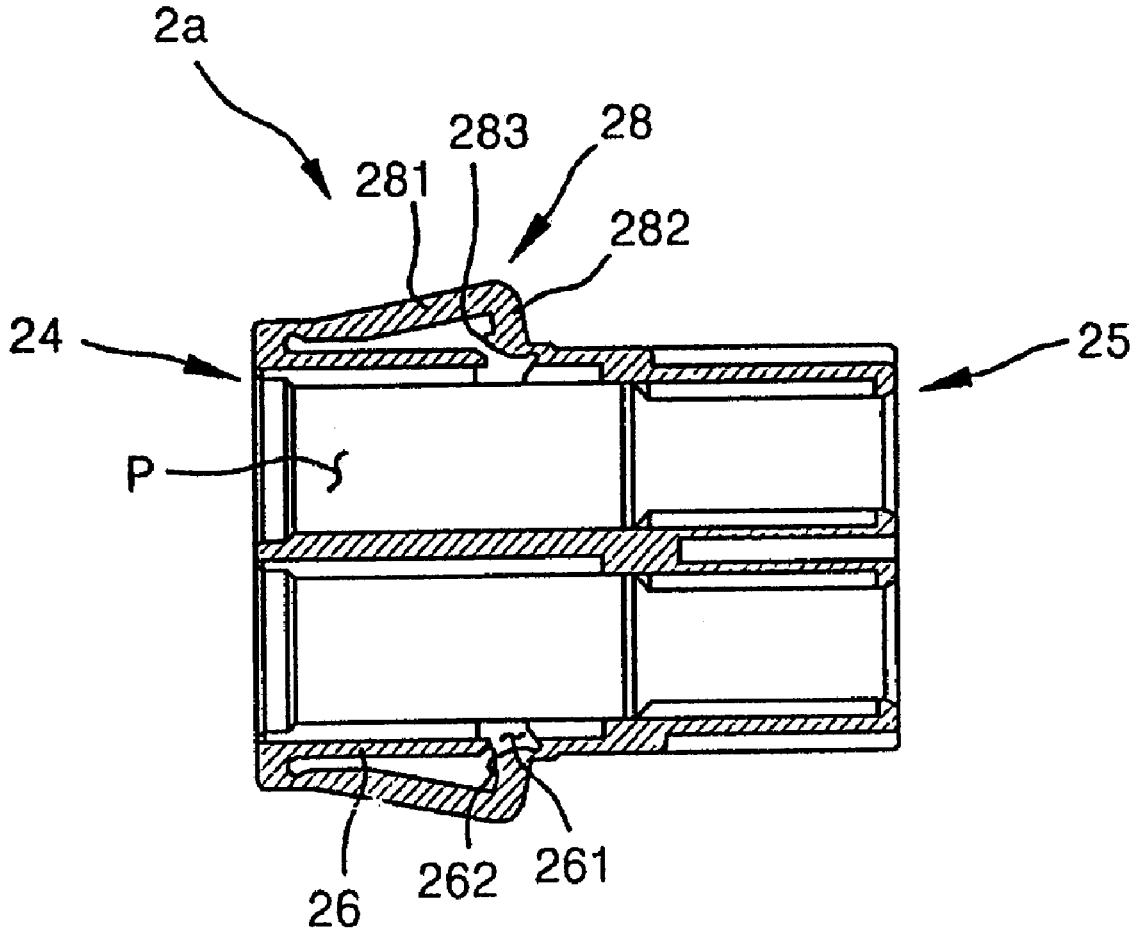

(Fig.3)
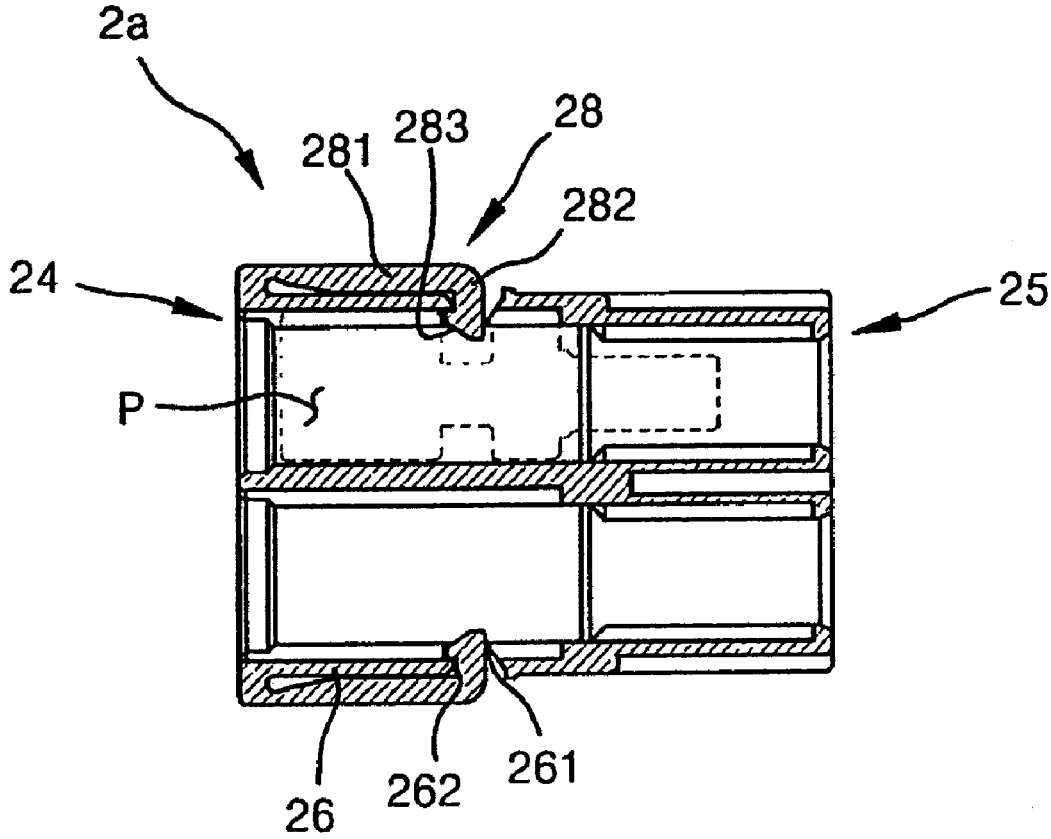
(Fig.4)
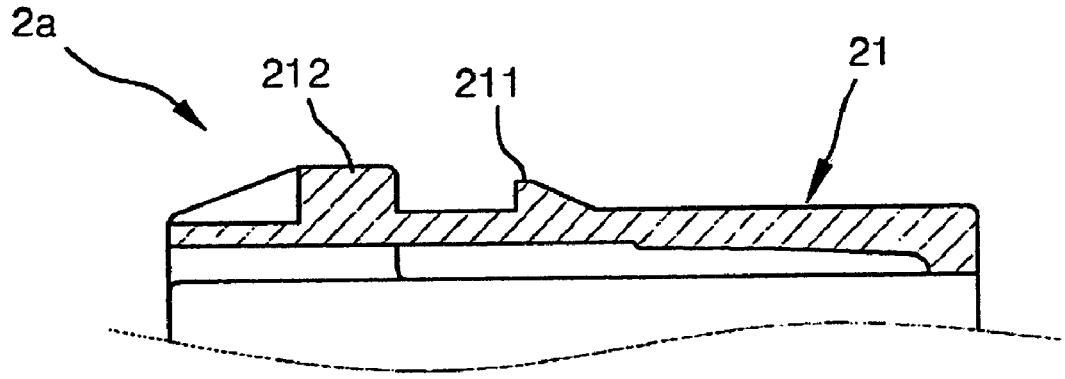

(Fig.5)
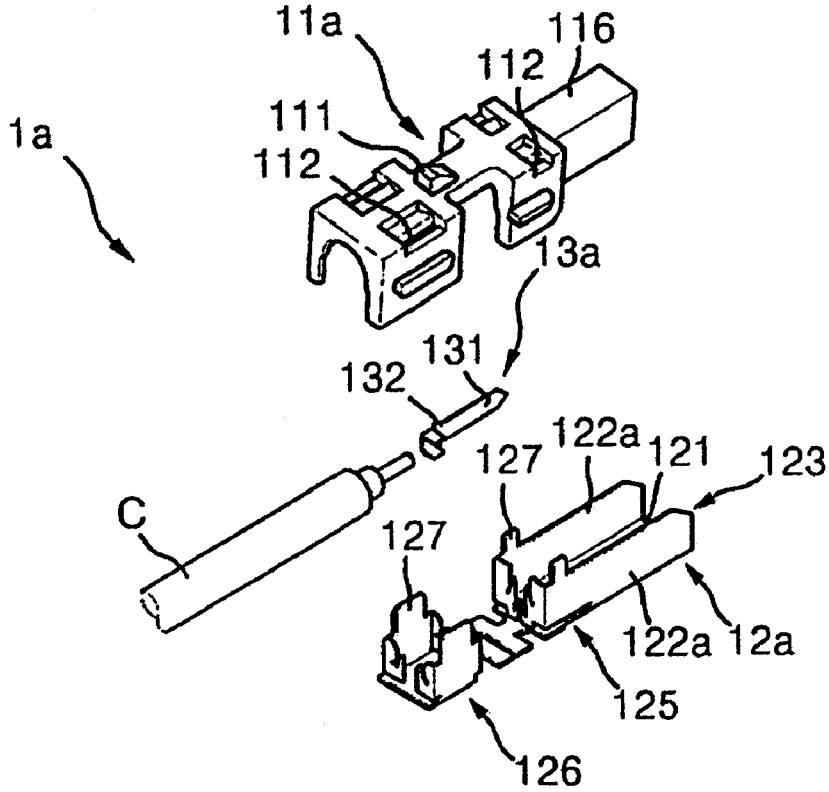
(a)
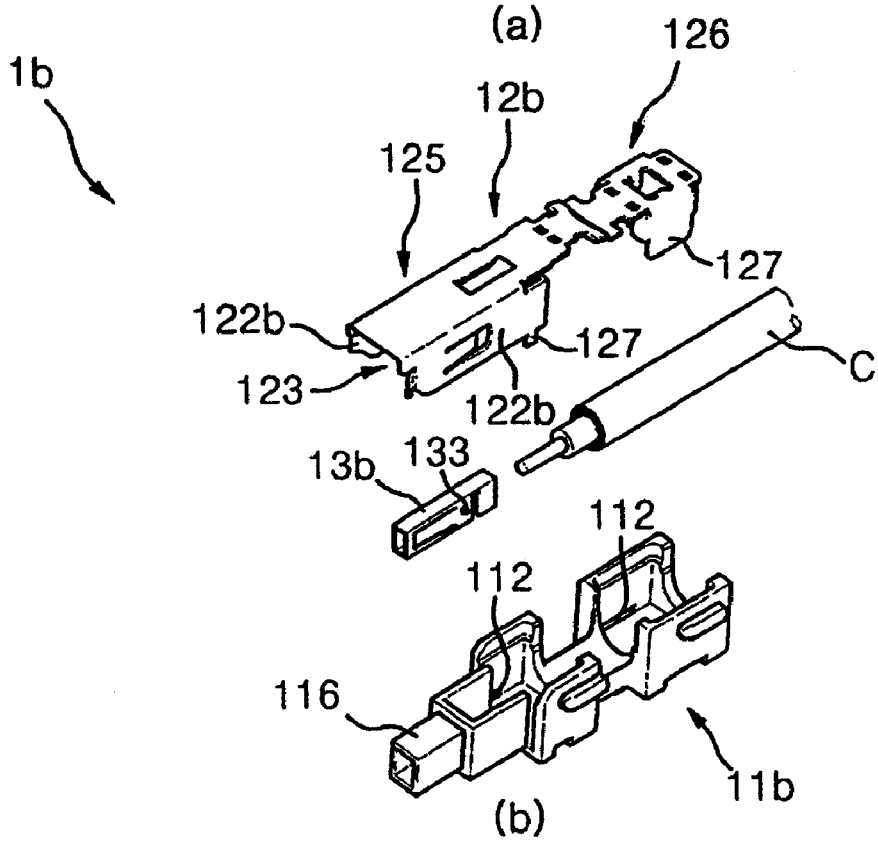
(b)

(Fig. 6)
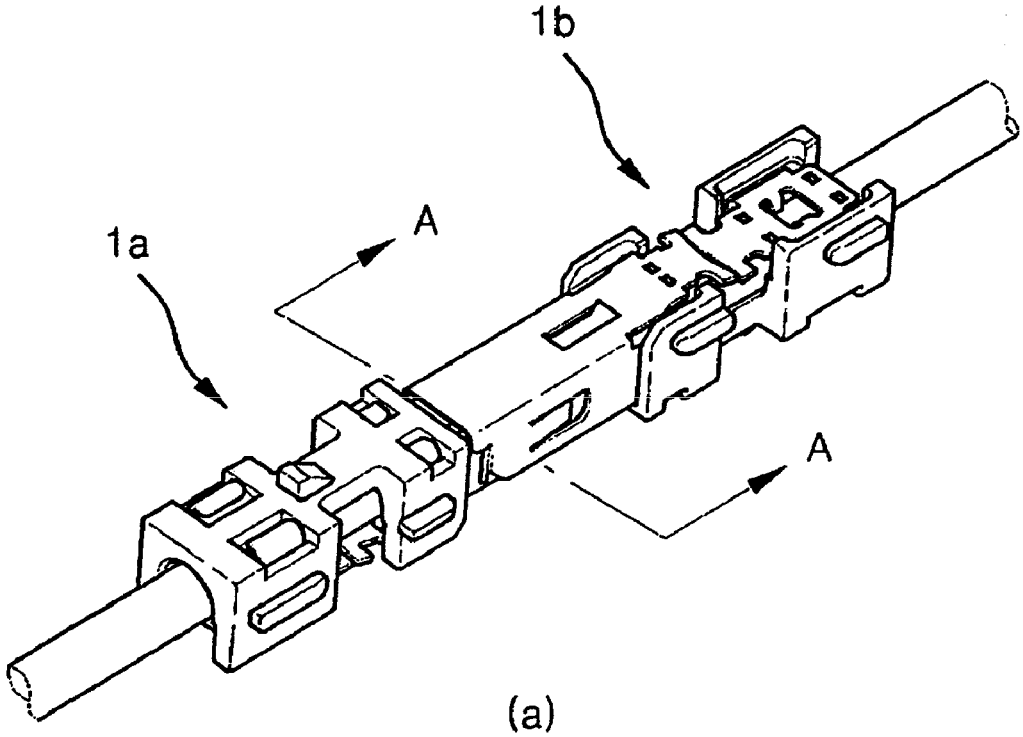
(a)
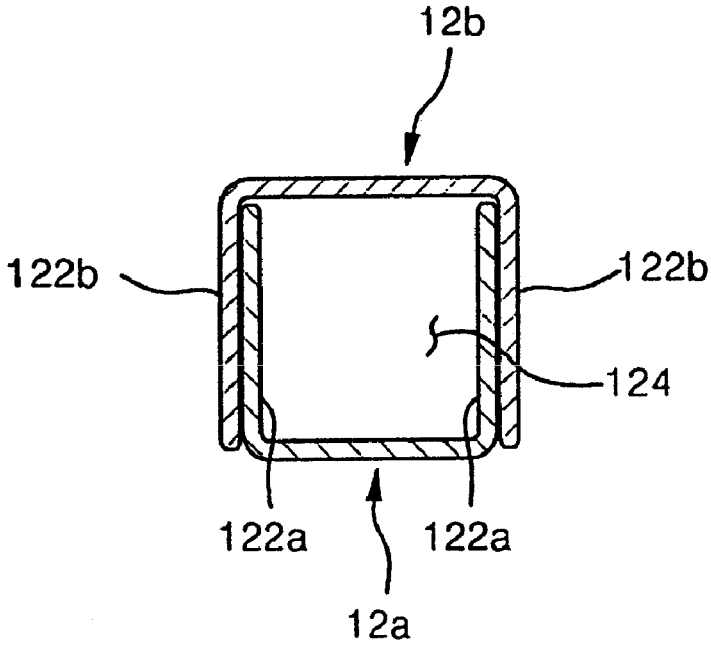
(b)

(Fig.7)
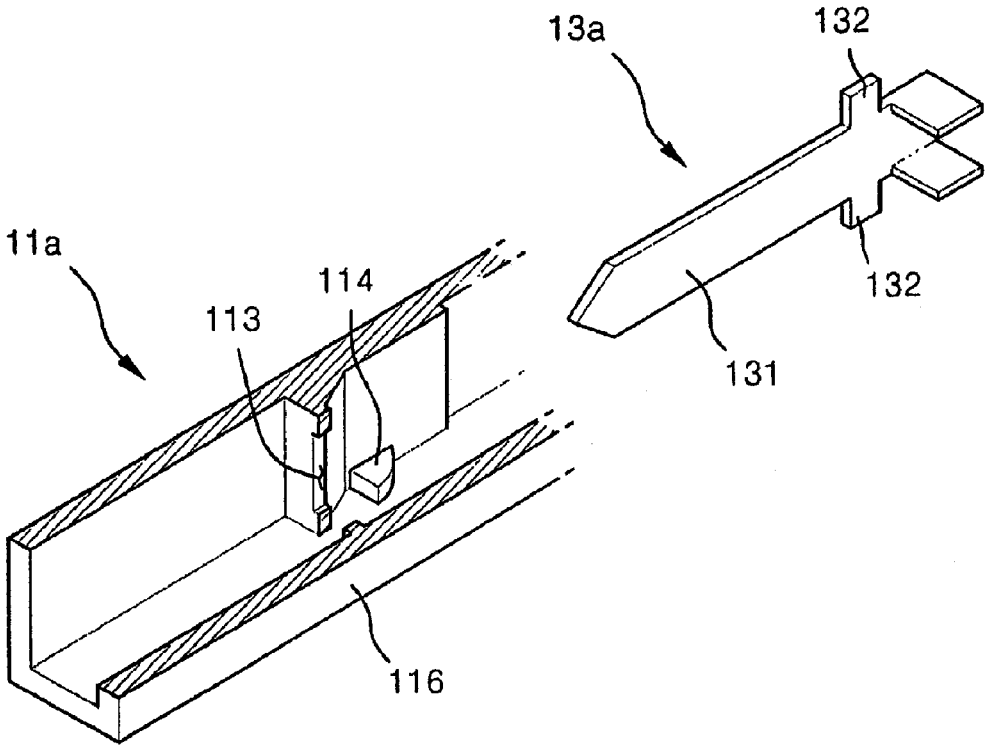
(Fig.8)
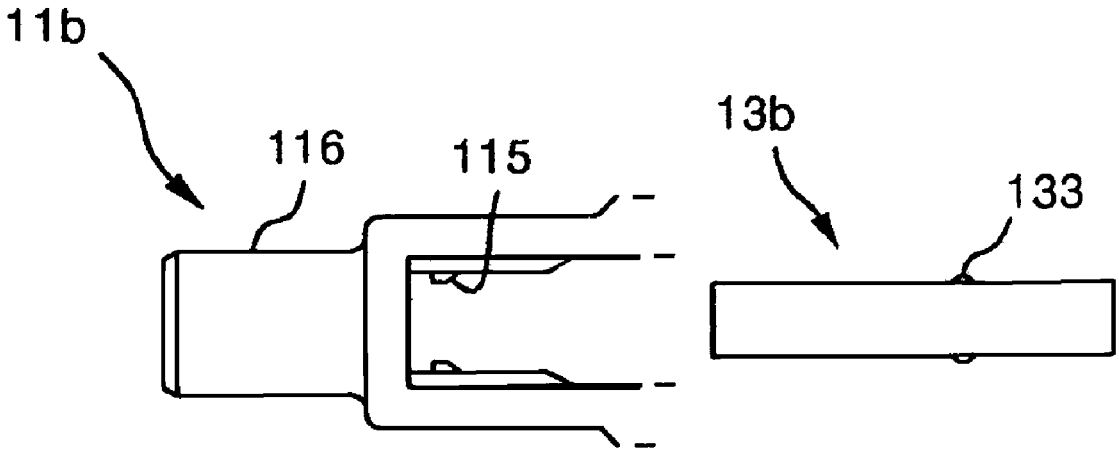

(Fig.9)
Prior Art
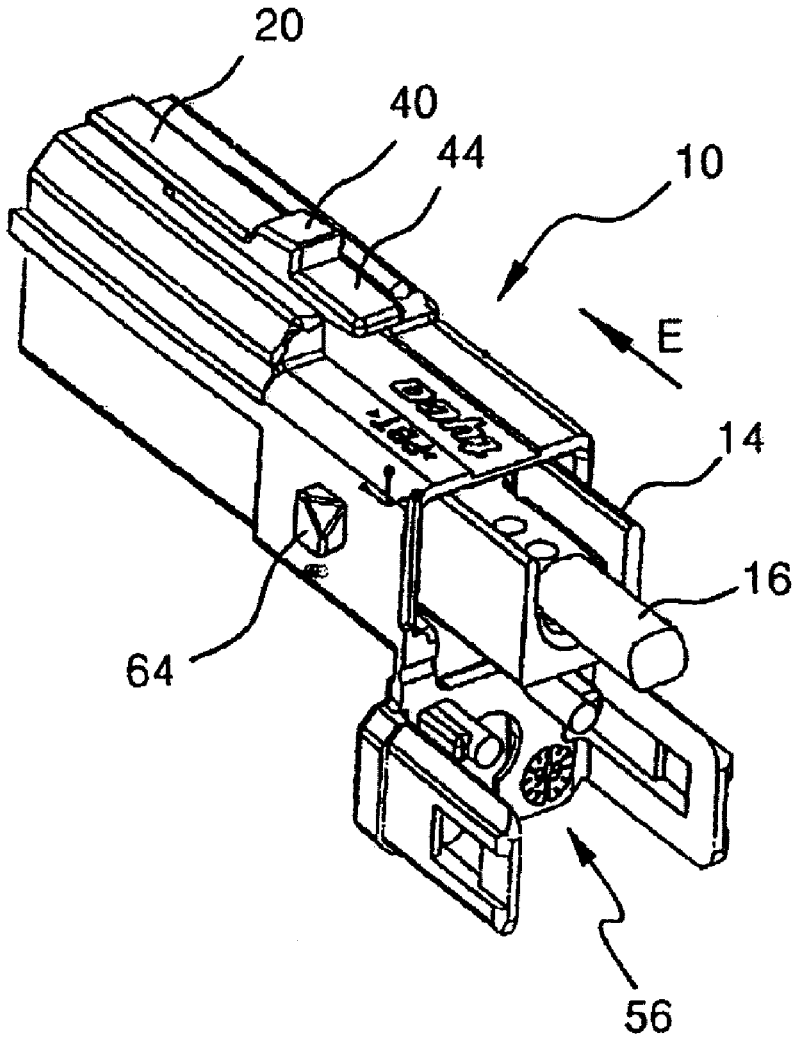

(Fig.10)
Prior Art
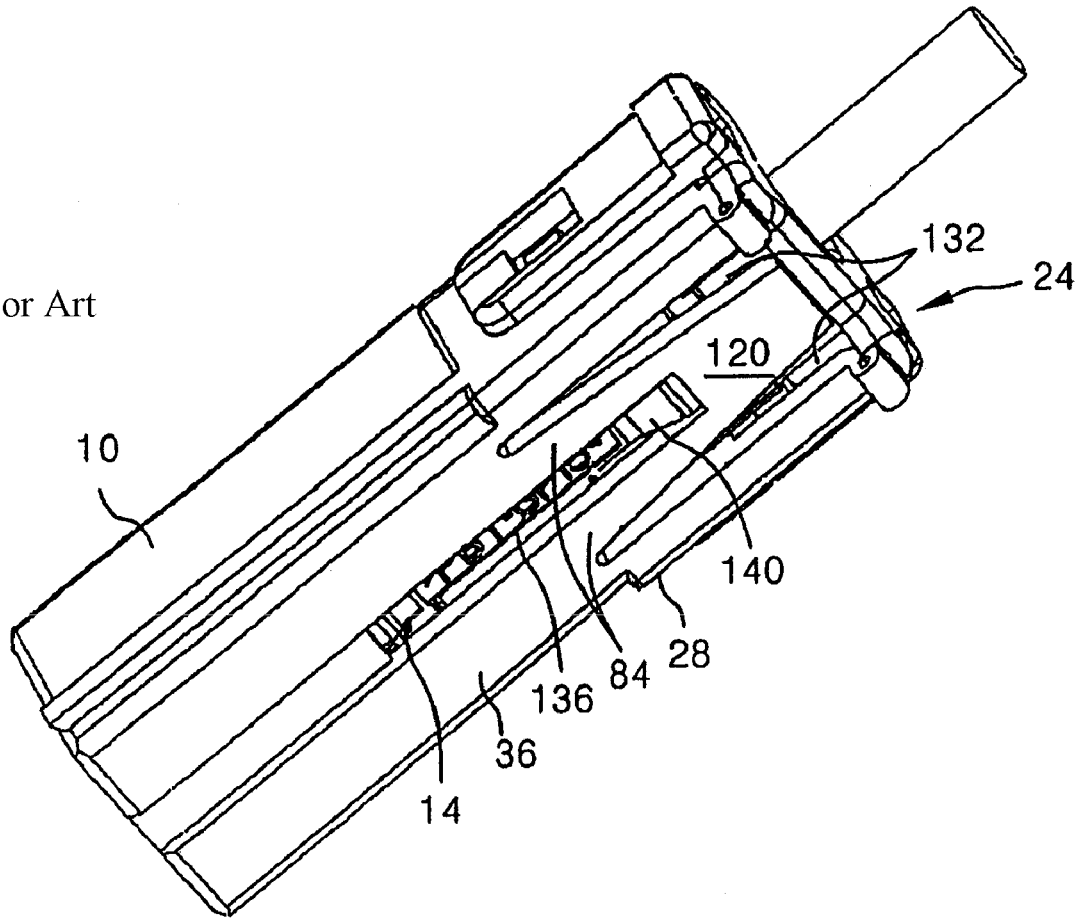

(Fig.11)
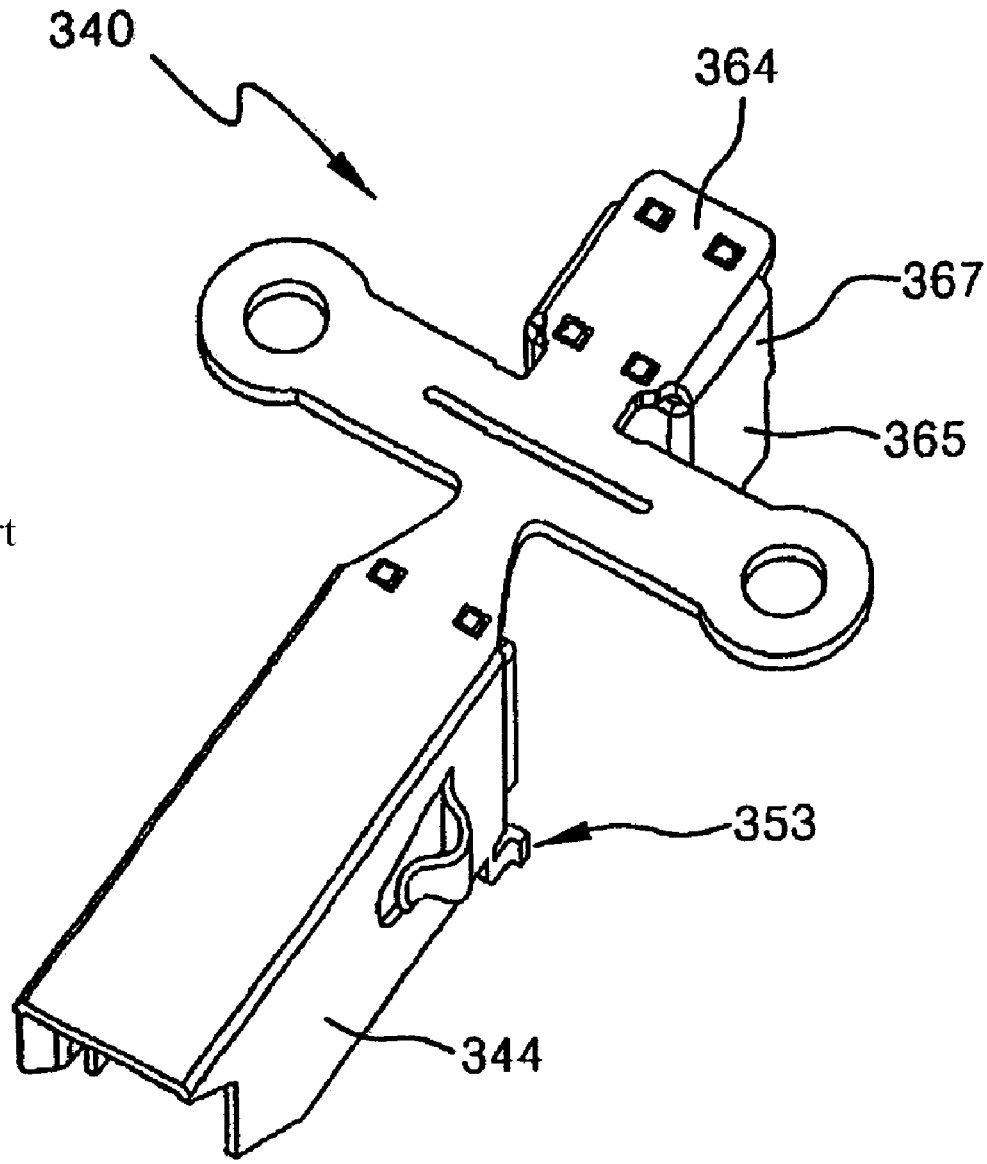
Prior Art (Fig.12)
Prior Art
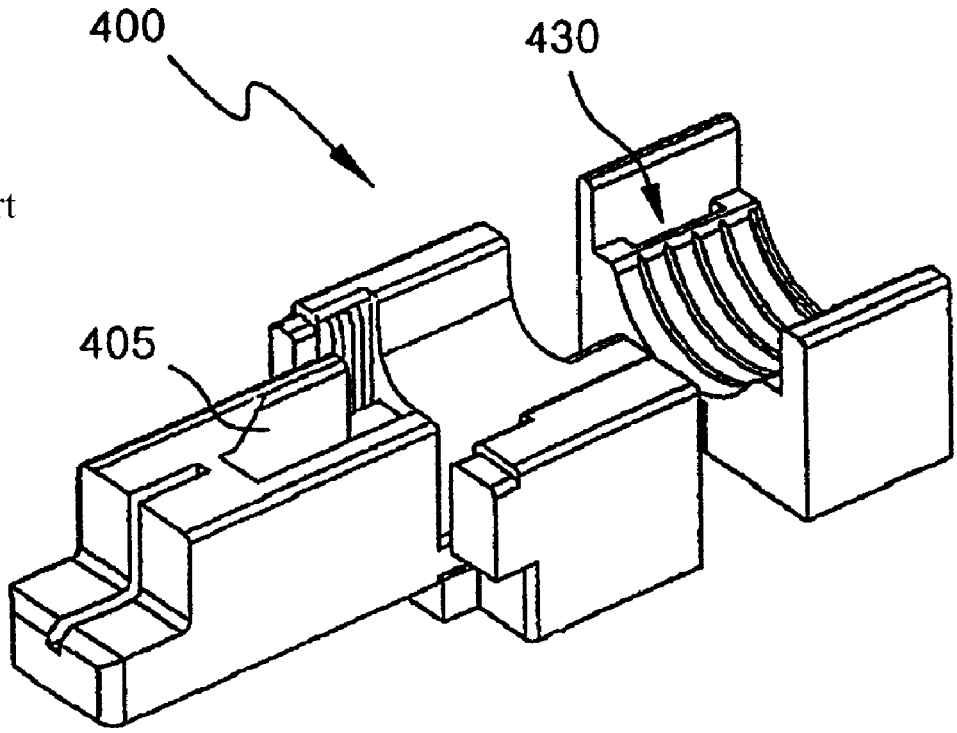
(Fig.13)
Prior Art
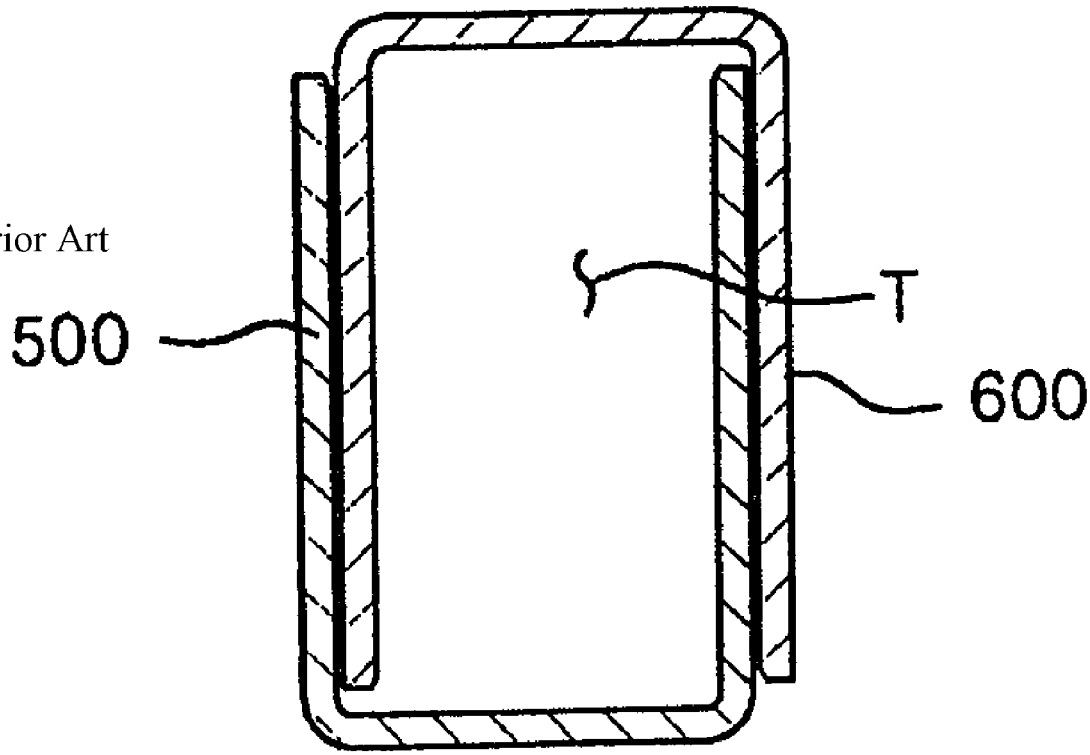

COAXIAL CABLE CONNECTOR FOR SECURE CONNECTION WITH A TERMINAL ASSEMBLY

CROSS-REFERENCE TO RELATED APPLICATIONS

This application is a continuation of PCT International Application No. PCT/KR2009/005152 filed Sep. 10, 2009, which claims priority under 35 U.S.C. §119 to Korean Patent Application No. 10-2008-0099149, filed Oct. 9, 2008.

FIELD OF INVENTION

The present invention relates to a connector used to interconnect coaxial cables, and, more particularly, to a coaxial cable connector that enhances coupling between internal components of coaxial cables.

BACKGROUND

A coaxial cable is a transmission line, including an internal conductor, i.e., a core, and an external conductor, i.e., a shielding net, to surround the core while being spaced apart from the core. The core and the shielding net are insulated from each other by a flexible insulator that surrounds the core. The shielding net may be made of conductive metal threads. Alternatively, various other kinds of materials, such as a conductive tape, may be used. The conductive tape and the shielding net may overlap one another to minimize external interference.

Such a coaxial cable has been widely used in near field wired communication. In recent years, the coaxial cable has attracted considerable attention for communication in hybrid vehicles. When the coaxial cable is used in a vehicle, it is necessary for the coaxial cable to have a small sectional area, while having the above-described construction, so as to improve spatial utilization. In addition, it is necessary to manufacture a connector to interconnect a plurality of coaxial cables as small as possible.

Conventional coaxial cable connectors are disclosed in U.S. Pat. No. 6,840,822 and No. 6,736,653, both of which have been filed by the applicant of the present application, prior to the filing of the present application.

As shown in FIG. 9, U.S. Pat. No. 6,736,653 discloses a coaxial cable connector constructed to have a structure in which a dielectric sub assembly 14 to support a coaxial cable 16 is inserted into a plug housing 10 in the direction indicated by an arrow E, and an open type hatch 56 hingedly coupled to one side of the plug housing 10 is caught by a latch grip part 64 such that the dielectric sub assembly 14 is fixedly received in the plug housing 10.

Also, as shown in FIG. 10, the plug housing 10 may include a prong 120, and the dielectric sub assembly 14 may include a latch 140, such that the dielectric sub assembly 14 is fixed to the plug housing 10 by means of the prong 120 and the latch 140.

Specifically, the prong 120 extends toward a receiving end 24 from a bottom wall 36 of the plug housing 10 along guide beams 84 such that the prong 120 is separated from side walls 28 by slots 132. Also, a gap 136 is formed in the middle of the prong 120. Consequently, when the dielectric sub assembly 14 is inserted into the plug housing 10, the latch 140 is fitted into the gap 136 formed in the prong 120, thereby achieving coupling between the dielectric sub assembly 14 and the plug housing 10.

This double fixing structure to secure the dielectric sub assembly 14 to the plug housing 10 may be applied to secure the dielectric sub assembly 14 to a receptacle housing in the same manner.

Referring back to FIG. 9, a latch 40 extends from a coupling end 20 of the plug housing 10 such that the latch 40 can be elastically moved upward and downward. The latch 40 is fitted in a support strip (not shown) of the receptacle housing, thereby achieving the coupling between the plug housing and the receptacle housing.

Also, a latch beam 44 extends from the rear end of the latch 40 such that a user pushes the latch beam 44 to move the latch 40, with the result that the receptacle housing is separated from the plug housing.

In the connector structure disclosed in U.S. Pat. No. 6,736,653, however, support latches 60 coupled to the latch grip part 64 are easily opened to opposite sides thereof, with the result that coupling force between the open type hatch 56 and the latch grip part 64 may be reduced due to interference of components located in the vicinity of the connector.

On the other hand, the latch beam 44 is formed in the shape of a cantilever, with the result that the latch 40 may be lifted highly from the surface of the plug housing 10, and therefore, it is difficult to reduce the size of the connector. Also, when vibration generated during the driving of a vehicle is transmitted to the cantilever type latch 40, and therefore, the latch 40 accumulates fatigue, the latch 40 loses elasticity, with the result that the latch 40 may be separated from the receptacle housing.

Meanwhile, U.S. Pat. No. 6,840,822 discloses the structure of the previously described dielectric sub assembly. The dielectric sub assembly includes a contact connected to a core of a coaxial cable, a contact shell connected to a shielding net of the coaxial cable, and an insulation housing to fix the contact shell and the contact to the coaxial cable.

Referring to FIG. 11, a deformation restraint clamp 364, formed at the rear end of the contact shell 340, includes with arms 365 protruding from opposite lips 367 thereof. The contact shell 340 is positioned at the front end thereof, at which the contact shell 340 is connected to another contact shell in a contact manner, with arch tips 353 protruding from opposite walls 344 of the front end thereof.

Also, referring to FIG. 12, the insulation housing 400 includes a shell receiving slot 405 and channels 430. The arch tips 353 and the arms 365 are inserted into the shell receiving slot 405 and the channels 430, respectively. Subsequently, the portions of the arms 365 protruding from the opposite ends of the respective channels 430 are bent, with the result that the deformation restraint clamp 364 is securely fixed to the insulation housing 400.

The front and rear ends of the contact shell 340, fixed to the insulation housing 400, are separated from each other during the manufacture of the contact shell 340. For this reason, the front end of the contact shell 340 is fixed to the insulation housing 400 by coupling force generated when the arch tips 353 are inserted into the shell receiving slot 405, with the result that front end of the contact shell 340 has lower coupling force than the rear end of the contact shell 340, which is bent to be securely coupled to the insulation housing 400. Therefore, the front end of the contact shell 340 may be separated from the insulation housing 400 due to external impact during the transportation of the connector.

As shown in FIG. 13, on the other hand, a front end 500 of a plug contact shell and a front end 600 of a receptacle contact shell, which are coupled to each other by the connector, are formed approximately in the shape of having the same sectional size. The front end 500 of the plug contact shell and the front end 600 of the receptacle contact shell are coupled to each other in a sequential side-to-side coupling manner to define a shielding space T. Neighboring coaxial cables placed in the shielding space are connected to each other via their contacts.

When the front end 500 of the plug contact shell and the front end 600 of the receptacle contact shell are coupled to each other in the sequential side-to-side coupling manner, however, the connection between the respective contact shells may be deteriorated due to assembly defects.

That is, when the contact shells are coupled to each other while any one of the contact shells is displaced in one direction, signal contacts may be subjected to interference, especially when under vibration.

SUMMARY

Therefore, the present invention has been made in view of the above problems, and it is an object of the present invention to securely fix a terminal assembly connected to a coaxial cable to a connector in a double locking manner, thereby preventing the terminal assembly from being unintentionally separated from the connector.

The coaxial cable connector according to the invention includes a male connector in which a male terminal assembly connected to a coaxial cable is fixed and a female connector in which a female terminal assembly configured to be connected to the male terminal assembly during coupling between the male connector and the female connector is fixed. The female terminal assembly is connected to another coaxial cable, wherein each of the male and female terminal assemblies has a catching protrusion provided at a top thereof, each of the male and female connectors has an elastic plate formed at a top of an receiving passageway thereof. The elastic plate includes a catching hole in which the corresponding catching protrusion is caught. Each of the male and female terminal assemblies includes a groove formed at a side thereof, and each of the male and female connectors has a fixing piece formed at a side of the receiving passageway thereof. The fixing piece is fitted in the corresponding groove through a side of a corresponding one of the male and female connectors, whereby the male and female terminal assemblies are dually fixed to the male and female connectors.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a partially exploded perspective view illustrating a coaxial cable connector according to the invention;

FIG. 2 is a plan view, in section, showing a male connector of the coaxial cable connector illustrated in FIG. 1;

FIG. 3 is a plan view, in section, showing the male connector of FIG. 2 in use;

FIG. 4 is a side view, in section, showing a coupling lever of the male connector of the coaxial cable connector illustrated in FIG. 1;

FIG. 5(*a*) is an exploded view of a male terminal assembly showing terminal assemblies of the coaxial cable connector shown in FIG. 1;

FIG. 5(*b*) is an exploded view of a female terminal assembly showing terminal assemblies of the coaxial cable connector shown in FIG. 1;

FIG. 6(*a*) is a perspective view showing the connection between the male and female terminal assemblies illustrated in FIG. 5;

FIG. 6(*b*) is a sectional view taken along line A-A of FIG. 6(*a*);

FIG. 7 is a partial sectional view showing a front end and a contact tip of a male insulation connector illustrated in FIG. 5;

FIG. 8 is a plan view showing a front end and a receiving tip of a female insulation connector illustrated in FIG. 5;

FIG. 9 is a perspective view showing a known connector when viewed from above;

FIG. 10 is a perspective view showing the known connector when viewed from below;

FIG. 11 is a perspective view showing a known contact shell;

FIG. 12 is a perspective view showing a known insulation housing; and

FIG. 13 is a sectional view showing the coupling between a conventional plug contact shell and a conventional receptacle contact shell.

DETAILED DESCRIPTION OF THE EMBODIMENT(S)

Now, the function, construction, and operation of a coaxial cable connector according to the present invention will be described in detail with reference to the accompanying drawings.

Connectors, terminal assemblies, tips, housings, and metal shells must be interpreted to include male and female pairs, respectively, even though the connectors, the terminal assemblies, the tips, the housings, and the metal shells are described hereinafter without making a distinction between male and female. Elements having the same functions are denoted by the same reference numerals even though they are included commonly in the respective male and female pairs.

With reference to FIG. 1, a coaxial cable connector 100 according to the invention is shown, having terminal assemblies 1*a* and 1*b* to which coaxial cables C are coupled, respectively, and connectors 2*a* and 2*b* in which the terminal assemblies 1*a* and 1*b* are fixed in, such a manner that at least one terminal assembly 1*a* is fixed in the connector 2*a*, and at least one terminal assembly 1*b* is fixed in the connector 2*b*.

The connectors 2*a* and 2*b* include male and female connectors 2*a* and 2*b* separably coupled to each other. During coupling between the male and female connectors 2*a* and 2*b*, front ends 101 of the male and female terminal assemblies 1*a* and 1*b* are coupled to each other, thereby achieving connection between the coaxial cables C.

Specifically, the female terminal assembly 1*b* or the male terminal assembly 1*a* is coupled to the female connector 2*b*, and the male terminal assembly 1*a*, or the female terminal assembly 1*b*, corresponding to the terminal assembly 1*b* or the male terminal assembly 1*a* positioned in the female connector 2*b* is coupled to the male connector 2*a*.

Hereinafter, the description will be given on the assumption that the female terminal assembly 1*b* is coupled to the female connector 2*b*, and the male terminal assembly 1*a* is coupled to the male connector 2*a*. In this case, each of the connectors 2*a* and 2*b* and each corresponding one of the terminal assemblies 1*a* and 1*b* forming a pair may have a receiving groove and a protrusion corresponding to the receiving groove to prevent confusion between male and female of the respective connectors 2*a* and 2*b* and the respective terminal assemblies 1*a* and 1*b*.

The male and female terminal assemblies 1*a* and 1*b* are configured to be fixedly inserted into the rear ends of the connectors 2*a* and 2*b*, respectively. The male and female terminal assemblies 1*a* and 1*b* have bodies formed in approximately the same shape excluding the shapes of the front ends 101, configured to contact each other, of the male and female terminal assemblies 1*a* and 1*b*. A catching protrusion 111 having an inclined insertion surface is formed at the top of the body of each of the male and female terminal assemblies 1*a* and 1*b*. Grooves 102 are formed at the opposite sides of the body of each of the male and female terminal assemblies 1*a* and 1*b*.

Meanwhile, rear ends 24 of the respective connectors 2*a* and 2*b*, into which the male and female terminal assemblies 1*a* and 1*b* are fixedly inserted, are opened to form receiving passageways 241. In the respective receiving passageways 241 are formed spaces P which extend to front ends 25 of the respective connectors such that the male and female terminal assemblies 1*a* and 1*b* are inserted into the corresponding spaces P.

Elastic plates 27, into which the catching protrusions 111 of the male and female terminal assemblies 1*a* and 1*b* are fitted, are positioned at the receiving passageways 241 of the respective connectors 2*a* and 2*b*. Fixing pieces 28, which are coupled to the grooves 102 of any one of the male and female terminal assemblies 1*a* and 1*b*, are formed at opposite sides of each of the connectors 2*a* and 2*b* adjacent to the receiving passageway 241 thereof. Consequently, the male and female terminal assemblies 1*a* and 1*b* are secured to each other by double locking using the elastic plates 27 and the fixing pieces 28.

One side 27*a* of each of the elastic plates 27 is connected to a flange 242 forming the receiving passageway 241 of each of the connectors 2*a* and 2*b*. The other side of each of the elastic plates 27 includes a notch such that the other side of each of the elastic plates 27 is elastically lifted upward. Also, a catching hole 271, into which the catching protrusion 111 of each of the male and female terminal assemblies 1*a* and 1*b* are fitted such that the catching protrusion 111 is caught in the corresponding catching hole 271, is positioned in each of the elastic plates 27. Also, a sliding groove 272 is formed at each of the elastic plates 27 such that the corresponding catching protrusion 111 is introduced from the receiving passageway 241 thereof to the vicinity of the corresponding catching hole 271.

Therefore, when the male and female terminal assemblies 1*a* and 1*b* are pushed into the corresponding connectors 2*a* and 2*b* from the receiving passageways 241 of the respective connectors 2*a* and 2*b*, the catching protrusions 111 are inserted through the respective receiving passageways 241 along the corresponding sliding grooves 272. The catching protrusions 111 having their respective inclined surface press the insides of the corresponding sliding grooves 272 to elastically lift the corresponding elastic plates 27 upward. Inclined surfaces may be formed at the insides of the respective sliding grooves 272 such that the elastic plates 27 can be more easily elastically lifted upward.

When the male and female terminal assemblies 1*a* and 1*b* are further moved, and, as a result, the catching protrusions 111 reach the corresponding catching holes 271, the elastic plates 27 are returned to their original positions by a restoring force, and, as a result, the catching protrusions 111 are fitted into the corresponding catching holes 271.

In this case, the other side of each of the elastic plates 27 is lifted upward about the corresponding flange 242, forming the receiving passageway 241 thereof, and therefore, each of the elastic plates 27 is prevented from being lifted by external interference as compared to a conventional elastic plate which is lifted upward in the vicinity of its receiving passageway 241.

In addition, grip holes 273 may further be formed to grip and lift the other sides 27*b* of the respective elastic plates 27 toward the front ends 25 of the respective connectors 2*a* and 2*b*. Each of the grip holes 273 may be formed in the shape of a hole having an enlarged incised portion.

A user may insert a longitudinal member, such as a clip, into each of the grip holes 273, such that each of the elastic plates 27 can be easily elastically lifted upward. When each of the elastic plates 27 is lifted upward using such as the longitudinal member, however, the lifted height of each of the elastic plates 27 is not great. Therefore, it is necessary for the user not to excessively lift each of the elastic plates 27 upward such that the connection between each of the elastic plates 27 and its receiving passageway 241 does not exceed the elastic limit and thus is not deformed.

That is, the elastic plates 27 are easily lifted upward by the further provision of the grip holes 273, thereby preventing the deformation of the elastic plates 27 and consequent damage to products.

Each fixing piece 28 is provided to securely achieve the physical engagement between each of the connectors 2*a* and 2*b* and each corresponding one of the terminal assemblies 1*a* and 1*b*, and includes a side plate 281 and a catching plate 282.

The side plate 281 extends from a side 26 of the corresponding connector 2*a* or 2*b* in the vicinity of the receiving passageway 241 thereof such that the side plate 281 is opened outward. The connection between the side plate 281 and the side 26 of the corresponding connector 2*a* or 2*b* may have a smaller thickness than the remaining portion of the side plate 281 such that the side plate 281 can be easily bent.

On the other hand, an insertion hole 261 is positioned at the side 26 of the corresponding connector 2*a* or 2*b* such that the insertion hole 261 corresponds to the corresponding groove 102 of the corresponding male or female terminal assembly 1*a* or 1*b*, which is inserted into the corresponding connector 2*a* or 2*b*. The catching plate 282, which is configured to be inserted into the insertion hole 261, extends approximately perpendicularly from the end of the side plate 281.

Therefore, when the male and female terminal assemblies 1*a* and 1*b* are inserted into the corresponding connectors 2*a* and 2*b*, and the side plates 281 are strongly pressed toward the corresponding sides of the respective connectors 2*a* and 2*b*, the catching plates 282 are inserted through the corresponding insertion holes 261 and then fitted into the corresponding grooves 102.

In this case, the catching plates 282 are caught simultaneously in the corresponding sides of the respective connectors 2*a* and 2*b* and the corresponding grooves 102 of the respective male and female terminal assemblies 1*a* and 1*b*, with the result that the movement of the male and female terminal assemblies 1*a* and 1*b* to the rears of the corresponding connectors 2*a* and 2*b* is prevented, and therefore, the separation of the male and female terminal assemblies 1*a* and 1*b* from the corresponding connectors 2*a* and 2*b* is prevented until a user opens the fixing pieces 28 again. The operation of the catching plates 282 is not achieved by the elasticity, but by the physical insertion. Consequently, the catching plates 282 are prevented from being separated from the corresponding grooves 102 due to vibration caused by driving of an automobile, for example, thereby achieving very secure coupling between the male and female terminal assemblies 1*a* and 1*b* and the corresponding connectors 2*a* and 2*b*.

In addition, a hooking protrusion 283 may be positioned at the end of each of the catching plates 282, such that the hooking protrusion 283 is caught by a step protrusion 262 formed in a corresponding one of the insertion holes 261, whereby the catching plates 282 are prevented from being separated from the corresponding insertion holes 261.

Specifically, the hooking protrusion 283, formed at the end of each of the catching plates 282 in the shape of a hook, goes over the step protrusion 262, protruding from the side 26 of each of the connectors 2*a* and 2*b*, constituting the side of each of the insertion holes 261, and is inserted into the corresponding groove 102. As a result, the hooking protrusion 283 of each of the inserted catching plates 282 is caught by the step protrusion 262 of the corresponding insertion hole 261, thereby further preventing the fixing pieces 28 from being separated from the corresponding male and female terminal assemblies 1*a* and 1*b*.

With respect to FIG. 4, the male connector 2*a* is shown, having a coupling lever 21. Front and rear ends of the coupling lever 21 are fixed to the male connector 2*a* such that the middle of the coupling lever 21 can be elastically moved upward and downward. The coupling lever 21 has a catching protrusion 211 formed at the top thereof such that the catching protrusion 211 is inserted into a catching groove 23 formed in the female connector 2*b*.

The coupling lever 21 is a longitudinal member the front and rear ends of which are fixed in the longitudinal direction in which the male connector 2*a* is inserted into the female connector 2*b* and the middle of which is spaced apart from a housing of the male connector 2*a* such that the middle of the coupling lever 21 can be elastically moved upward and downward. The front and rear coupling areas between the coupling lever 21 and the male connector 2*a* or the sectional area of the longitudinal coupling lever 21 may be adjusted to change the elasticity.

The catching protrusion 211 is provided at the top of the coupling lever 21. The catching protrusion 211 has an inclined front surface which is inserted into the female connector 2*b*.

Therefore, when the male connector 2*a* is inserted into the female connector 2*b*, the catching protrusion 211 is caught by the inside of the female connector 2*b*, with the result that the middle of the coupling lever 21 is elastically moved downward such that the middle of the coupling lever 21 is near to the outside of the housing of the male connector 2*a*. Subsequently, when the catching protrusion 211 reaches the catching groove 23 of the female connector 2*b*, the coupling lever 21 is returned to its original position by restoring force, with the result that the catching protrusion 211 is fitted into the catching groove 23, thereby achieving the coupling between the male and female connectors 2*a* and 2*b*.

In this case, the distance between the middle of the coupling lever 21 and the male connector 2*a* is minimized since the opposite ends of the coupling lever 21 are fixed to the male connector 2*a*. Also, the total thickness of the female connector 2*b*, configured to receive the male connector 2*a*, is minimized since the distance between the middle of the coupling lever 21 and the male connector 2*a* is minimized. Consequently, it is possible to minimize the total size of the coaxial cable connector 100.

In addition, the coupling lever 21, the opposite ends of which are fixed, more satisfactorily bears vibration generated from a vehicle than in a conventional latch structure constructed in the form of a cantilever. Even when the coupling lever 21 is used in a vibration environment for a long period of time, therefore, the coupling lever 21 does not lose elasticity due to fatigue transmitted from the vibration, thereby achieving stable use of the coupling lever 21 for a long period of time.

In addition, the coupling lever 21 may be provided at the rear end thereof with a protrusion 212 to allow a user to easily elastically move the coupling lever 21 downward when the user separates the male connector 2*a* from the female connector 2*b*. In this case, the protrusion 212 protrudes from the rear end of the coupling lever 21 which is not inserted into the female connector 2*b*. Preferably, the protrusion 212 has a lower height than the female connector 2*b* in which the male connector 2*a* is coupled.

Also, the protrusion 212 may have a greater width than the lateral width of the coupling lever 21 such that the user can easily press the protrusion 212 with the user's finger(s).

In addition, opposite sides 213 of the protrusion 212 may further extend to the left and right and may then be bent downward to be connected to the corresponding receiving passageway 241 of the male connector 2*a* such that the coupling lever 21 can be easily moved downward when the user presses the protrusion 212.

Consequently, the protrusion 212 is moved downward to some extent, when the user presses the protrusion 212, with the result that the middle of the coupling lever 21 is moved, and therefore, the catching protrusion 211 is separated from the corresponding catching groove 23.

The protrusion 212 comes into contact with the front end of the female connector 2*b* during coupling between the male connector 2*a* and the female connector 2*b*. Consequently, the protrusion 21 serves as a stopper to restrict the insertion depth of the male connector 2*a*. That is, the insertion depths of the male and female connectors 2*a* and 2*b* required for accurate coupling between the male and female terminal assemblies 1*a* and 1*b* provided in the male and female connectors 2*a* and 2*b*, respectively, may be more accurately maintained by the protrusion 212 serving as the stopper.

On the other hand, the male connector 2*a* may be provided with side walls 22 to prevent the protrusion 212 from being pushed by other connectors, electric wires, etc. located in the vicinity of the male connector 2*a*. In this case, it is preferable for the side walls 22 to be spaced apart from the protrusion 212. It is also preferable for the side walls 22 to have the same height as the protrusion 212. Also, the front end of each of the side walls 22 may be bent such that the front end of each of the side walls 22 serves as a stopper like the protrusion 212.

With respect to FIG. 5, the terminal assembly 1*a*, 1*b* includes an insulation housing 11*a*, 11*b* to be securely coupled to the outside of a corresponding coaxial cable C, a metal shell 12*a*, 12*b* coupled to the insulation housing 11*a*, 11*b* and connected to a shielding net of the corresponding coaxial cable C, and a tip 13*a*, 13*b* connected to the core of the corresponding coaxial cable C.

In this case, the insulation housings 11*a* and 11*b*, the metal shells 12*a* and 12*b*, and the tips 13*a* and 13*b* are divided into a group including a female insulation housing 11*b* formed at the front end of the female terminal assembly 1*b* to receive the front end of a male insulation housing 11*a*, a female metal shell 12*b*, including a bottom 121 and opposite sides, to be coupled to the female insulation housing 11*b*, and a hollow receiving tip 13*b* formed in the shape of a rectangular bar, and another group including a male insulation housing 11*a* configured to be inserted into the front end of the female insulation housing 11*b* at the front end of the male terminal assembly 1*a*, a male metal shell 12*a* formed in a shape approximately symmetrical to the female metal shell 12*b*, and a contact tip 13*a* connected to the core of the coaxial cable C and configured to be inserted into the receiving tip 13*b*.

The construction of the female terminal assembly 1*b* will be described in more detail. The core C1 of the coaxial cable C is electrically coupled to the receiving tip 13*b* such that the core C1 protrudes toward the front end 116 from the interior of the female insulation housing 11*b*. The female metal shell 12*b* is coupled to the female insulation housing 11*b* while the female metal shell 12*b* is electrically connected to the shielding net C2 of the coaxial cable C. The male terminal assembly 1*a* has a similar construction to that of the female terminal assembly 1*b*.

The details in construction of the male and female terminal assemblies 1*a* and 1*b* are identical to those disclosed in U.S. Pat. No. 6,840,822, which was previously described, and therefore, repetitious descriptions thereof will be omitted.

On the assumption that the sides of the respective insulation housings 11*a* and 1*b* of the male and female terminal assemblies 1*a* and 1*b* where the catching protrusions 111 are formed are upsides of the respective insulation housings 11*a* and 1*b* of the male and female terminal assemblies 1*a* and 1*b*, the male and female terminal assemblies 1*a* and 1*b*, provided in the male and female connectors 2*a* and 2*b*, respectively, are arranged to be coupled to each other while one of the male and female terminal assemblies 1*a* and 1*b* is reversed. During coupling between the male and female connectors 2*a* and 2*b*, therefore, a front end 123 of the male metal shell 12*a* is coupled to a front end 123 of the female metal shell 12*b* to define a shielding space 124 having a rectangular sectional shape (see FIGS. 6*a* and 6*b*).

Of course, the sectional shape of the shielding space 124 is decided based on the sectional shapes of the male and female metal shells coupled to each other. Therefore, the sectional shape of the shielding space 124 is not limited only to the rectangle.

As shown in FIG. 6(*b*), the shielding space 124 is defined by coupling the male metal shell 12*a* to the female metal shell 12*b* such that the male metal shell 12*a* is surrounded by the female metal shell 12*b*. Specifically, opposite sides 122*b* of the female metal shell 12*b* cover the outs ides of opposite sides 122*a* of the male metal shell 12*a*.

As a result, the shielding space 124 is stably defined, and therefore, the electrical connection between the male and female metal shells 12*a* and 12*b* is well-maintained even when gaps occur between the opposite sides 122*a* and 122*b* of the male and female metal shells 12*a* and 12*b* due to assembly defects or even when sides of the male metal shell 12*a* do not completely contact the corresponding sides of the female metal shell 12*b* due to manufacturing errors. In particular, even when vibration is generated, at least one of the opposite sides of the male metal shell 12*a* constantly contacts the corresponding side of the female metal shell 12*b*. As a result, the shielding efficiency of the shielding space 124 is uniformly maintained, and therefore, external interference in transmission of an electrical signal through the core of the coaxial cable is reduced.

Consequently, it is possible to more effectively prevent the frequency disturbance of the core due to external electric waves than in a conventional sequential side-to-side coupling between the metal shells.

FIG. 7 shows the front end and the contact tip of the male insulation connector illustrated in FIG. 5.

The metal shell 12*a*, 12*b* is integrally formed to achieve easy and convenient assembly between the insulation housing 11*a*, 11*b* and the coaxial cable. However, after coupling of the metal shell 12*a*, 12*b* to the insulation housing 11*a*, 11*b* is completed, the metal shell 12*a*, 12*b* is divided into two pieces, i.e., a front contact part 125 configured to contact another metal shell to define a shielding space 124 and a fixing part located at the rear of the contact part 125 to securely fix the coaxial cable to the insulation housing 11*a*, 11*b*.

The contact part 125 and the fixing part 126 are positioned at opposite sides 122*a*, 122*b* thereof with support legs 127 protruding toward the insulation housing 11*a*, 11*b* such that the coaxial cable is securely fixed to the insulation housing 11*a*, 11*b*. Also, the insulation housing 11*a*, 11*b* is provided with channels 112 corresponding to the respective support legs 127. The support legs 127 are inserted into the corresponding channels 112 formed in the insulation housing 11*a*, 11*b*, and then the ends of the support legs 127 are bent to achieve coupling between the metal shell 12*a*, 12*b* and the insulation housing 11*a*, lib.

In this case, the respective support legs 127 are inserted through the channels of the insulation housing 11*a*, 11*b* and then bent such that the respective support legs are supported, and therefore, more secure coupling of the contact part 125 and the fixing part 126 to the insulation housing 11*a*, 11*b* is achieved than in a conventional arch-type tip insertion structure.

With respect to FIG. 8, the front end and the receiving tip 12*b* of the female insulation connector is shown.

During coupling between the male and female terminal assemblies 1*a* and 1*b*, the contact tip 13*a* is inserted into the receiving tip 13*b* such that the cores of the coaxial cables are connected to each other. At this time, the contact tip 13*a* and the receiving tip 13*b* must be fixed in the insulation housings 11*a* and 11*b* in position to achieve accurate connection between the contact tip 13*a* and the receiving tip 13*b*.

In particular, when the tips 13*a*, 13*b* are pushed backward during coupling between the male and female terminal assemblies 1*a* and 1*b*, the connection between the cores is defective, with the result that it is not possible to achieve a function as the coaxial cable connector 100 at all. Therefore, it is necessary for the respective tips 13*a* and 13*b* to be accurately located in required positions of the front ends of the respective insulation housings 11*a* and 11*b*.

To this end, protrusions 133 may be formed at opposite sides of a rectangular bar body of the receiving tip 13*b* adjacent to the rear end thereof, and protruding engagement parts 115 are formed at the female insulation housing 11*b* such that the protrusions 133 engage with the respective protruding engagement parts 115. As a result, when the receiving tip 12*b* is coupled in the female insulation housing 11*b*, the receiving tip 12*b* is forcibly pushed such that the protrusions 133 go over the respective protruding engagement parts 115, thereby achieving the forced coupling between the protrusions 133 and the protruding engagement parts 115.

In this case, the opposite protrusions 133 of the receiving tip 13*b* are caught by the protruding engagement parts 115, even when force the receiving tip 13*b* is pushed backward, during coupling between the contact tip 13*a* and the receiving tip 13*b*, thereby preventing the receiving tip 13*b* from being pushed backward.

On the other hand, the contact tip 13*a*, which is positioned in the male terminal assembly 1*a*, includes a longitudinal piece 131 configured to be inserted into the receiving tip 13*b* to achieve the electrical connection between the contact tip 13*a* and the receiving tip 13*b* and protruding pieces 132 extending from opposite sides of the longitudinal piece 131 adjacent to the rear end thereof.

Also, the male insulation housing 11*a* is positioned at the front end thereof with a slit 113 through which the contact tip 13*a* is inserted in an upright state. A protruding stopper 114 is positioned at the rear of the slit 113, to support the protruding pieces 132, thereby preventing the separation of the contact tip 13*a* from the male insulation housing 11*a*. The protruding stopper 114 is positioned such that the protruding stopper 114 is inclined toward the rear end of the male insulation housing 11*a* and is perpendicular toward the front end of the male insulation housing 11*a*.

In this case, when the contact tip 13*a* is inserted into the slit 113 of the male insulation housing 11*a*, the protruding pieces 132 are elastically deformed, while the protruding pieces 132 go over the inclined surface of the protruding stopper 114. Subsequently, when the contact tip 13*a* is further moved forward and, as a result, is completely coupled to the slit 113 of the male insulation housing 11*a*, the protruding pieces 132 are moved to the other side of the protruding stopper 114 and then supported by the perpendicular surface of the protruding stopper 114. Consequently, the protruding pieces 132 are supported by the protruding stopper 113, even when force is applied to push the contact tip 13*a* backward during coupling between the contact tip 13*a* and the receiving tip 13*b*, thereby preventing the contact tip 13*a* from being pushed backward and fixing the contact tip 13*a* in position.

Various embodiments have been described in the best mode for carrying out the invention.

As apparent from the above description, the coaxial cable connector according to the present invention has an effect in that the terminal assembly is coupled to the connector by double locking, using the elastic piece and the fixing piece, and therefore, the terminal assembly is prevented from being unintentionally separated from the connector, thereby improving product reliability.

In particular, the fixing piece is inserted into the connector simultaneously through the side of the connector and the groove of the terminal assembly, thereby securely fixing the terminal assembly. Also, the operation of the catching plate is not achieved by the elasticity. Consequently, the catching plate is prevented from being separated from the groove of the terminal assembly due to fatigue caused by vibration, thereby achieving very secure coupling between the terminal assembly and the connector.

On the other hand, the other side of the elastic plate is lifted upward about the flange forming the receiving passageway thereof, and therefore, the elastic plate is prevented from being lifted by external interference as compared to a conventional elastic plate which is lifted upward in the vicinity of its receiving passageway.

In addition, it is possible for a user to easily lift the elastic plate upward using the longitudinal member by further provision of the grip hole, thereby reducing a possibility of the elastic plate being damaged due to deformation of the elastic plate exceeding elastic limit caused by excessively lifting the elastic plate.

On the other hand, the fixing piece is further provided with the hooking protrusion, with the result that it is further difficult for the fixing piece to be separated from the insertion hole, thereby further improving coupling between the connector and the terminal assembly.

On the other hand, the opposite ends of the coupling lever provided at the male connector are fixed to the male connector, with the result that it is possible to reduce the height of the coupling lever, thereby reducing the total size of the connector. Therefore, a plurality of connectors may be used in a small area, thereby improving spatial utilization.

Also, the protrusion is provided at the rear end of the coupling lever, with the result that it is possible for a user to easily and conveniently separate the male and female connectors from each other by pressing the protrusion. In addition, it is possible to accurately restrict the depth of the male connector inserted into the female connector.

Also, the male connector is further provided with the side wall, with the result that it is possible to prevent the protrusion from being pushed due to interference of external components, thereby preventing the male and female connectors from being separated from each other.

On the other hand, the coupling between the male and female metal shells is achieved such that the male metal shell is surrounded by the female metal shell during coupling between the male and female terminal assemblies. Therefore, it is possible to achieve more stable coupling between the male and female metal shells than a conventional sequential side-to-side coupling between the metal shells.

On the other hand, the support legs, provided at the contact part and the fixing part of the metal shell, are inserted through the channels of the insulation housing and then bent. Therefore, it is possible to securely fix the metal shell to the insulation housing, thereby preventing the occurrence of assembly defects.

On the other hand, the receiving tip and the contact tip are supported by the protruding engagement parts or the protruding stopper formed at each of the insulation housings, respectively, with the result that it is possible to prevent the receiving tip and the contact tip from being pushed backward. Even when the male and female connectors are repeatedly separated from and connected to each other several times, therefore, it is possible to stably maintain the connection between the cores, thereby improving product reliability.

Although an embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A coaxial cable connector comprising:

a male connector having a male terminal assembly connected to a coaxial cable, a receiving passageway, and an elastic plate formed at a top of the receiving passageway thereof, the male terminal assembly having a catching protrusion positioned at a top thereof and a groove formed at a side thereof;

a female connector having a female terminal assembly configured to connect with the male terminal assembly, another receiving passageway, and another elastic plate formed at a top of the other receiving passageway thereof, the female terminal assembly connects to another coaxial cable and includes another catching protrusion positioned at a top thereof and another groove formed at a side thereof;

wherein the male and female terminal assemblies are received into the receiving passageway and the other receiving passageway respectively, wherein the elastic plate and the other elastic plate include a catching hole in which the catching protrusion is correspondingly secured, wherein the male and female connectors include a fixing piece formed at a side of the receiving passageway and the other receiving passageway respectively;

wherein each fixing piece is in the groove and the other groove through a side of the male or female connectors, whereby the male and female terminal assemblies are dually secured to the male and female connectors.

2. The coaxial cable connector according to claim 1, wherein the elastic plate has one side connected to a flange forming the receiving passageway such that the other side is elastically lifted upward, the catching protrusion being caught in the catching hole of the elastic plate.

3. The coaxial cable connector according to claim 2, wherein the male connector includes a grip hole through which the other side of the elastic plate is gripped and lifted upward.

4. The coaxial cable connector according to claim 1, wherein the other elastic plate has one side connected to a flange forming the receiving passageway such that the other side is elastically lifted upward, the catching protrusion being caught in the catching hole of the elastic plate.

5. The coaxial cable connector according to claim 4, wherein the female connector includes a grip hole through which the other side of the other elastic plate is gripped and lifted upward.

6. The coaxial cable connector according to claim 1, wherein the fixing piece includes a side plate extending from the side of the other receiving passageway of the female connector such that the side plate is opened outward.

7. The coaxial cable connector according to claim 6, wherein the fixing piece further includes a catching plate extending from an end of the side plate toward an insertion hole formed through the side of the female connector such that the catching plate is fixedly secured in the other groove of the female terminal assembly.

8. The coaxial cable connector according to claim 6, wherein the other fixing piece includes another side plate extending from the side of the receiving passageway of the male connector such that the other side plate is opened outward.

9. The coaxial cable connector according to claim 8, wherein the other fixing piece further includes another catching plate extending from an end of the other side plate toward another insertion hole formed through the side of the male connector such that the other catching plate is fixedly secured in the groove of the male terminal assembly.

10. The coaxial cable connector according to claim 1, wherein the male connector is provided with a coupling lever, the coupling lever includes the catching protrusion formed at a top thereof such that the catching protrusion is inserted into a catching groove formed in the female connector.

11. The coaxial cable connector according to claim 10, wherein the coupling lever is configured such that front and rear ends of the coupling lever are fixed to the male connector such that a middle of the coupling lever is elastically movable upward and downward.

12. The coaxial cable connector according to claim 11, wherein the coupling lever is positioned at a rear end of the coupling lever with a protrusion contacting a front end of the female connector to restrict an insertion depth of the male connector.

13. The coaxial cable connector according to claim 12, wherein the protrusion is configured to elastically move the coupling lever downward when the protrusion is pressed.

14. The coaxial cable connector according to claim 1, wherein the male and female terminal assemblies respectively include male and female insulation housings and male and female metal shells respectively connected to shielding nets of the coaxial cable and the other coaxial cable respectively.

15. The coaxial cable connector according to claim 14, wherein the male and female metal shells are configured to surround front ends of the respective male and female insulation housings, and the female metal shell surrounds the male metal shell to define a shielding space during coupling between the male and female terminal assemblies.

16. The coaxial cable connector according to claim 15, wherein the male and female metal shells include support legs formed at a contact part located at a front thereof and at a fixing part located at a rear thereof.

17. The coaxial cable connector according to claim 14, wherein the support legs are inserted through channels formed in the male or female metal shells and then bent such that the male and female metal shells are coupled to the male and female insulation housings, respectively.

18. The coaxial cable connector according to claim 15, wherein the female terminal assembly includes a receiving tip connected to a core of the coaxial cable, the receiving tip being positioned at opposite sides thereof with protrusions.

19. The coaxial cable connector according to claim 18, wherein the female insulation housing includes protruding engagement parts configured to engage with the respective protrusions.

20. The coaxial cable connector according to claim 14, wherein the male terminal assembly includes a contact tip connected to a core of the coaxial cable, the contact tip has a protruding piece extending elastically from a side thereof.

21. The coaxial cable connector according to claim 20, wherein the male insulation housing has a protruding stopper to support the protruding piece to prevent separation of the contact tip from the male insulation housing.

* * * * *